United States Patent [19]

Sasaki

[11] Patent Number: 4,627,813

[45] Date of Patent: Dec. 9, 1986

[54] THERMAL FIXING APPARATUS

[75] Inventor: Yoshitaka Sasaki, Saitama, Japan

[73] Assignee: Hitachi Metals, Ltd., Tokyo, Japan

[21] Appl. No.: 614,192

[22] Filed: May 25, 1984

[30] Foreign Application Priority Data

May 25, 1983 [JP] Japan ..... 58-91974
May 25, 1983 [JP] Japan ..... 58-91975

[51] Int. Cl.[4] ..... G03G 15/20

[52] U.S. Cl. ..... 432/60; 355/3 FU; 219/216

[58] Field of Search ..... 355/3 FU, 14 FU, 3 R; 432/60; 219/216, 388

[56] References Cited

U.S. PATENT DOCUMENTS 3,861,863 1/1975 Kudsi ..... 219/216 X
4,075,455 2/1978 Kitamura et al. ..... 219/388 X
4,163,892 8/1979 Komatsu et al. ..... 219/388 X
4,223,203 9/1980 Elter ..... 219/216
4,474,456 10/1984 Kobayashi et al. ..... 219/388 X

*Primary Examiner*—R. L. Moses
*Attorney, Agent, or Firm*—Sughrue, Mion, Zinn, Macpeak & Seas

[57] ABSTRACT

A thermal fixing apparatus for use with a copying machine or electronic printer in which an operating temperature of the apparatus after energization is quickly reached. A pair of fixing rolls is provided, at least one of which in heated. The outer surface of the other is covered with an elastically deformable outer layer. The two rolls are pressed into abutment with one another to form a nip therebetween of the predetermined width. A plate-shaped heater element is disposed prior to the nip adjacent the path of conveyance of toner-image-bearing paper sheets to be fixed. The plane of the heater element is preferably parallel to the plane of the paper. The surface temperature of the heater element has a temperature higher at central portions than at widthwise ends thereof to provide uniform fixing conditions.

3 Claims, 7 Drawing Figures

THERMAL FIXING APPARATUS

BACKGROUND OF THE INVENTION

The present invention relates to an improvement in a thermal fixing apparatus employed in a device such as a copying machine, electronic printer or the like which is used to fix a toner image on a support such as a paper sheet passed between a pair of mutually press-contacted rollers, at least one of which performs a heating function.

Some thermal roll-type fixing apparatuses used to perform the fixing function in a copying machine or electronic printer have previously been known (see, for instance, Laid Open Japanese Patent Applications Nos. 49-81041 and 53-145635 and Japanese Patent Publication No. 54-19347). One example of these apparatuses comprises a pair of rollers, one of which is composed of a heat-resist elastic layer of a material such as silicone rubber or the like and/or a refractory material of layer such as polytetrafluoroethylene coated on the outer surface of a metallic hollow cylinder which is provided with a heat source such as an infrared lamp, halogen lamp or nichrome wire therein, and the another roll of a metallic hollow cylinder without a heating source. A sectional drawing of a conventional apparatus of this type is depicted in FIG. 1. In FIG. 1, reference numerals 1, 2 and 3 indicate, respectively, a heated roll, a pressure roll, and side plates for supporting the heat roll and the pressure roll at the two ends thereof through bearings (not shown). Reference numerals 4 and 5 respectively designate a paper feeding guide and a paper carrying thereon a toner image 6.

The heat roll 1 is formed by covering the outer surface of a hollow metal cylinder 8 with a refractory parting agent layer 9. A heat source 7 is positioned in the interior of the metal cylinder 8. The pressure roll 2 is constructed by covering the outer surface of a hollow metal cylinder 10 with an elastic and refractory material of layer 11. The rolls 1 and 2 are mounted in mutual press-contact with one another so as to form a nip through which the paper carrying the toner image passes. The pressure applied between the two rolls is controlled to provide a predetermined nip width in the direction in which the paper is fed (referred to as a contact width, later in this specification).

In operation, the heat source 7 is activated to supply heat to the surface of the heat roller 1 through the metal core and insulating layer. The rolls 1 and 2 are rotated in the directions indicated by arrows in FIG. 1 to convey the paper 5 along the paper feeding guide 4 in the direction indicated by another arrow.

The type of fixing apparatus shown in FIG. 1 is advantageous when compared with other thermal fixing apparatuses such as the oven type and flash lamp type in that the energy consumption is less, the mechanism is more reliable, and a higher speed fixing operation is provided. However, this apparatus is disadvantageous in that a relatively long preheating time such as at least one minute is required for the temperature of the surface of the heat roll to be raised to an operating temperature range on the order of 150° to 200° C. after the power source is turned on.

To reduce this preheating time, the diameter or the thickness of the hollow cylinder of the roll may be decreased to thereby decrease the heat capacity of the roll. Doing so, however, results in the requirement that greater pressure must be exerted to press-contact the rollers. Although ordinarily 0.5 to 1.0 kg/cm of pressure is exerted, so that sufficient contact width is formed in order to ensure sufficient contact time for fixing. Also, the reduction in the diameter or thickness of the roll lessens the rigidity of the roll to resist the greater pressure to be applied. In the case of insufficient pressure for press-contact of rollers, there occurs insufficient pressure for fixing and an insufficient contact width in the longitudinal center of rollers which cause a poor fixing. Still further, providing more power to the heater suffers from a drawback in that during preheating the heat source may cause the temperature at the surface of the roll to overshoot the desired operating temperature, thereby resulting in a longer stabilization time and no reduction of the preheating time.

Another approach, such as disclosed in Laid Open Japanese Patent Publications Nos. 50-27550, 50-93658, 50-161244, 51-9457 and 54-83440, is to provide an auxiliary heating source to shorten the preheating time However, this prior approach has not been put to practical use, because the paper tends to be burned in the case of contact with the auxiliary heating source and the thermal efficiency is low.

SUMMARY OF THE INVENTION

Accordingly, it is an object of the invention to provide a thermal fixing apparatus in which the drawbacks of the prior art mentioned above have been eliminated.

Specifically, it is an object of the present invention to provide a thermal fixing apparatus in which the preheating time is reduced. It is another object of the present invention to reduce the diameter and the thickness of metal cylinder used.

In accordance with the above and other objects, the invention provides a thermal fixing apparatus including a pair of rolls, at least one of which is provided with a heater therein, and the other roll has an elastically deformable outer surface. The two rolls are abutted against one another to define a nip therebetween through which a support carrying a toner image thereon passes. A plate-like form of heater element having a width corresponding to the axial length of the rolls is provided. The heater element has a plate-like form, arranged parallel to the passage of the support carrying the toner image and extends to the two rolls. One edge of the heater element is located adjacent to the surface of one of the rolls. It is preferable to form the plate heater with a semiconductor such as a PTC thermistor or an NTC thermistor, for quick heat up.

DESCRIPTION OF THE PREFERRED EMBODIMENTS

Referring now to the schematic cross-sectional view of FIG. 2, the present invention will be described in detail with reference to preferred embodiments thereof.

Figure 1:
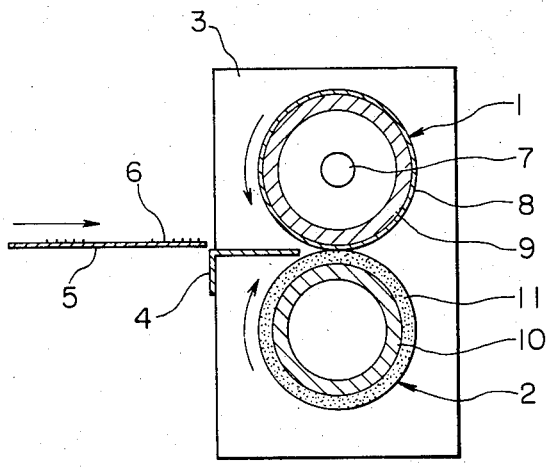
FIG. 1 PRIOR ART
FIG. 1 is a schematic cross-sectional view of a conventional thermal fixing apparatus.
Figure 2:
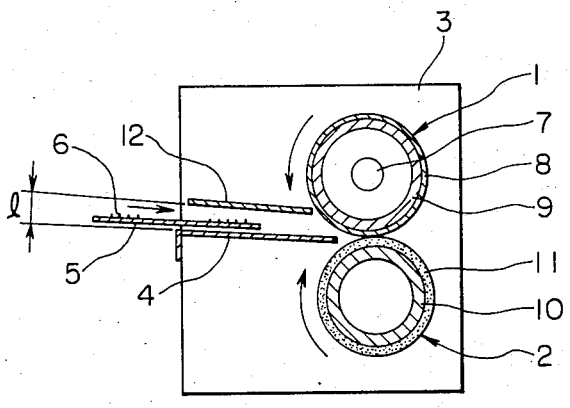
FIG. 2 is a schematic cross-sectional view of a first embodiment of a thermal fixing apparatus of the invention.

In FIG. 2, the same elements as those in the apparatus of FIG. 1 are identified by the same reference numerals, and accordingly further detailed descriptions thereof will not be necessary.

Specifically, in FIG. 2, the construction and arrangement of the heated roll 1 and the pressure roll 2 are the same as employed in the apparatus shown in FIG. 1, except that each of the heated roll 1 and the pressure roll 2 in FIG. 2 comprises a hollow cylindrical member having a diameter and thickness less than those of the corresponding roll in FIG. 1 so as to be provided with a lower thermal capacity.

Further in FIG. 2, a plate-like heater element 12 is provided. The heater element 12, which has substantially a plate form, has a width substantially equal to that of the length of heat roll. The heater element 12 is arranged facing the guide 4.

When a paper 5 bearing a toner image 6 thereon is transported in the direction indicated by an arrow in FIG. 2, along the paper feeding guide 4 towards the nip between the heat roll 1 and the pressure roll 2, the heater element 12 is energized, thereby to heat the toner image carried on the paper 5 to a temperature preferably higher than the softening point (typically, 100° to 130° C.) of the toner. As a result, the toner is in a semi-molten state prior to fixing, so that quite satisfactory fixing is obtained without the need of increasing the fixing pressure and the contact width of the nip between the two rolls. Because the heater element 12 is located at a position close to the heat roll 1 as shown in FIG. 2, it is necessary for the temperature of the heater element 12 to be sufficiently low that the refractory parting agent layer 8 forming the outside surface of the heat roller 1 is not damaged. For instance, if this layer is formed of polytetrafluoroethylene, the surface temperature of the heater element 12 should not exceed above 250° C. Also, from a standpoint of energy consumption, it is desirable that a lower temperature be maintained.

For improved heating efficiency, the heater element 12 should be located as close as possible to the paper feeding guide 4, preferably, by a distance of no more than about 20 mm. The gap length l between the heater element 12 and the paper feeding guide 4 should be sufficiently great, however, that paper jamming problems are not induced thereby.

Figure 3:
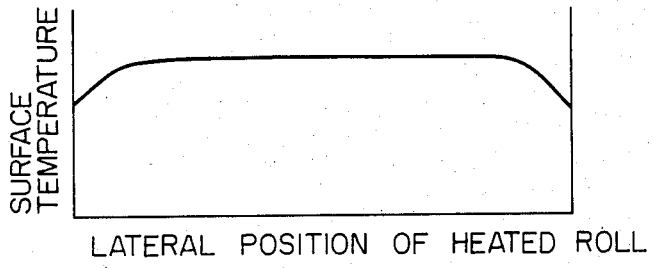
FIG. 3 is a graph showing the temperature distribution in the longitudinal direction on the surface of the heat roll in the apparatus of FIG. 2.
Figure 4:
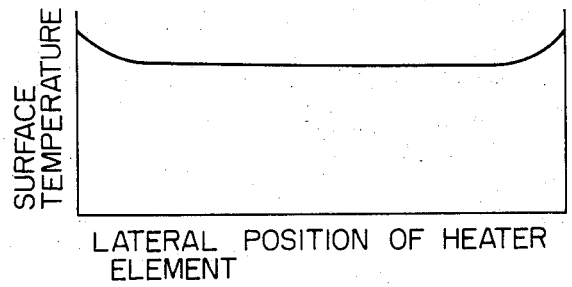
FIG. 4 is a graph showing the temperature distribution on the surface of the heater element in the longitudinal direction.

Preferably, the heater element 12 should be arranged so as to provide a temperature distribution as indicated by the graph of FIG. 4; that is, a pattern in which the two end portions of the heater element 12 have a surface temperature higher than its central portion. By so doing, when the support 5 bearing the toner image 6 is moving in the direction indicated by the arrow in FIG. 2, the toner image 6 is heated by radiation by the heater element 12, thereby providing the temperature distribution pattern indicated in FIG. 4. The support 5 then enters the nip between the heated roll 1 and the pressure roll 2. Due to the presence of the mounting components as bearings or cogwheel in the end portions of the heat roll 1, the heat roll 1 has a temperature distribution as indicated in FIG. 3. That is, the temperature at the end portions of the heated roll 1 is less than one at its central portion. Accordingly, the toner image which was preheated more in the end portions will be heated more in the central portion in the nip of rolls, and it will be melted uniformly throughout its width and fixed on the support.

Figure 5:
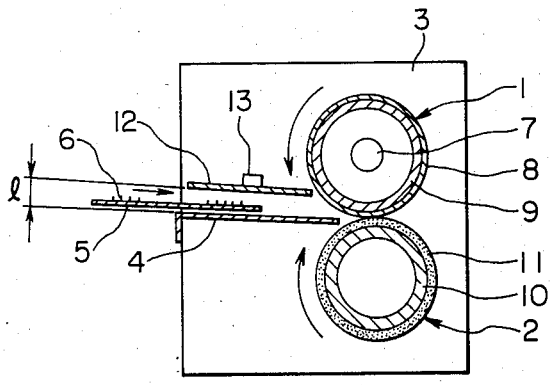
FIG. 5 is a schematic cross-sectional view of a second embodiment of thermal fixing apparatus constructed in accordance with the present invention.

If desired, a temperature sensor 13, as shown in FIG. 5, can be provided to control the surface temperature of the heater element 12 and also heat roll 1.

EXAMPLE 1

A thermal fixing apparatus as depicted in FIG. 2 was constructed. In this apparatus, the heat roll 1, which had a fixing length of 280 mm, comprises a stainless steel tube 8 having an outside diameter of 27 mm and a wall thickness of 1 mm. Shafts were attached to the opposite end portions of the tube. The tube was coated with "Teflon" (trademark of Dupont Company) to a thickness of about 20 to 35 μm. A halogen lamp extending along the 280 mm length was provided inside the tube 8. The pressure roll 2 was constructed with an aluminum alloy tube having on its outer surface a silicone rubber layer. The heater element 12 composed of a PTC thermistor plate sandwiched with two metal electrodes had a width of 50 mm so as to accommodate a B4 size sheet of paper. The spacing between the heater element 12 and the paper was approximately 7 mm. The line contact pressure between the heat roll 1 and the pressure roll 2 was 0.5 kg/cm. The heat roll was rotated by a driver, then the pressure roll was rotated by the heat roll because of friction between them. The support used was a $B_4$ size sheet of paper having a thickness of about 100 μm. The transport speed of the paper was 150 mm/sec under the condition shown in Table 1 below.

During a fixing operation carried out with this apparatus, no paper jams occurred. Also, no significant offsetting of the toner was observed, and the overall quality of the image fixing was quite good. Operation of the apparatus could be successfully commenced about 25 seconds after the halogen lamp 7 and plate heater were energized.

Pressure rolls of various outer diameters were employed, specifically, in a range of 20 to 300 mm, and the pressure between the pressure roll 2 and heat roll 1 was varied so as to provide a varied contact width, specifically, in a range of 3.0 to 3.5 mm. The fixing width of rolls were varied in a range of 260~280 mm. Satisfactory fixing operations were carried out for these ranges. The toner employed has as principle ingredients 36 wt. % of bisphenol-type polyester resin (specifically, a number mean molecular weight of 5,700, a weight average molecular weight of 63,000, a glass transition temperature of 67° C., and a softening point of 123° C.), 5 wt. % of styrene butadiene copolymer (Goodyear S5B), 1.5 wt. % of polypropylene (Sanyo Chemical Viscol 550P), 2.5 wt. % of an antistatic agent (Orient Chemical Bontron E83) and 55 wt. % of a magnetic powder (Toda Industrial EPT 1000). Each ingredient was first kneaded in a pressure-type kneader for 20 minutes at a temperature of 140° C., cooled until solidification, and then placed in a jet mill for pulverization. Then, 0.6 wt. % of silica was added in micropowder form to the pulverized mixture of the above ingredients, after which a dry blending operation was carried out at room temperature. The mixture was then passed through a hot air stream at 150° C. in an atomized state as a spherical treatment process. Finally, 0.5 wt. % of silica was added in micropowder form to thereby obtain a magnetic toner having a particle size in the range of 5 to 20 microns. The toner particles so produced had a frictional charge voltage less than $-5$ $\mu c/g$ and an electrical resistivity of greater than $10^{14}$ ohm-cm or greater.

TABLE 1

| | Plate Heater | Heat Roll |
|---|---|---|
| Surface Temperature | 160° C. | 180° C. |
| Power Consumption | 300 W | 700 W |
| | (Total Electric Energy: 1000 W) | |

In the similar experiment where the plate heater had a surface temp. of 250° C., it was found that the gap length l should be about 25 mm to obtain optimum fixing characteristics. If the fixing speed, namely, the speed at which the paper is conveyed, is changed, the width and surface temperature of the heater and the surface temperature of the pressure roll should be changed.

EXAMPLE 2

Conditions were the same as for Example 1, except that the temperatures at the opposite ends and the central portion of the heater element were as shown in Table 2 below:

TABLE 2

| | | Heating Element | Heat Roll |
|---|---|---|---|
| Surface Temperature | Central Portion | 160° C. | 180° C. |
| | Opposite Ends | 180° C. | 160° C. |
| Power Consumption | | 300 W | 700 W |

EXAMPLE 3

Figure 6:
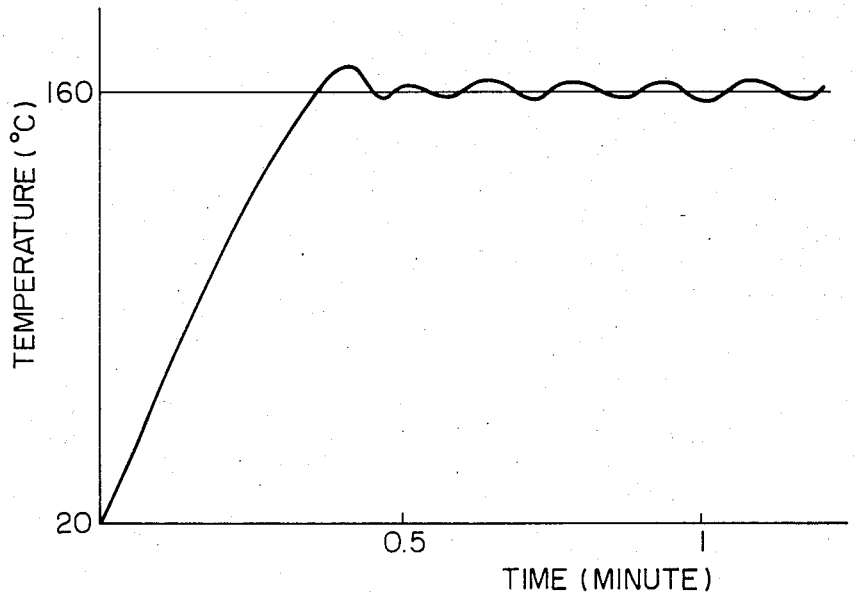
FIG. 6 is a graph showing the relationship between the surface temperature and heating time of a heater element emploued in the invention.
Figure 7:
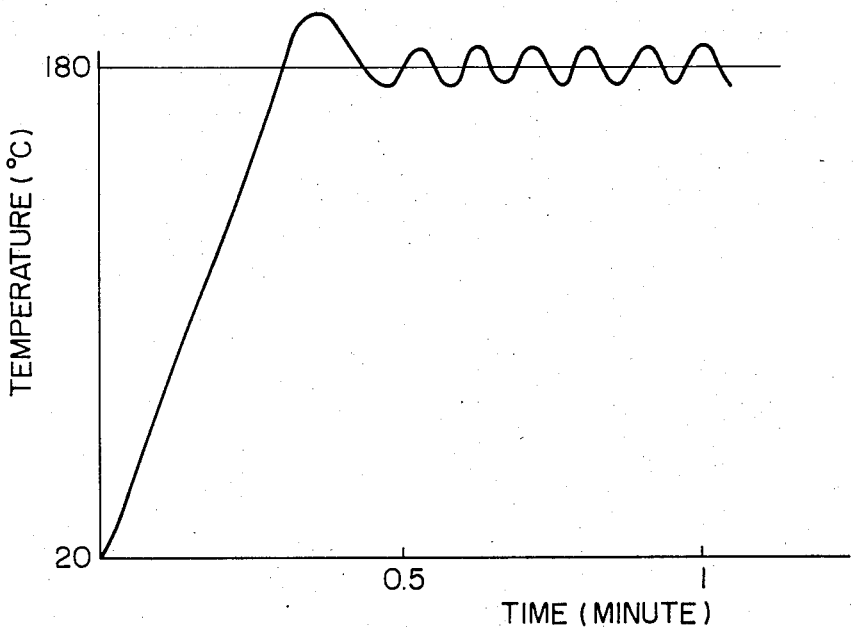
FIG. 7 is a graph showing the relationship between the surface temperature and heating time of the heat roll.

In this example, a temperature sensor 13 (see FIG. 5) was provided on the surface of the heater element 12 with which the temperature of the surface of the heater element 12 was maintained at 160° C. In this case, the relationship between the surface temperature and heating time of the heater element 12 were shown in FIG. 6, and the relationship between the surface temperature and heating time of the heat roller 1 were shown in FIG. 7.

In the cases of Examples 2 and 3 also, very satisfactory fixing results were obtained. With the present invention as described above, the period of time after energization before the apparatus is ready to perform a thermal fixing operation is significantly decreased over the prior art approaches. Moreover, good quality image fixing results are provided thereby.

This completes the description of the preferred embodiments of the invention. Although preferred embodiments have been described, it is believed that numerous modifications and alterations thereto would be apparent to one of ordinary skill in the art without departing from the spirit and scope of the invention.

I claim:

1. A thermal fixing apparatus for a sheet bearing a tonr image comprising: a pair of rolls in contact with one another forming a nip therebetween, at least one of said rolls being heated, the other of said rolls being covered with an elastically deformable outer layer; and a plate-like form of heater element having a width corresponding substantially to an axial length of said pair of rolls, and disposed substantially parallel to the passage of image-bearing sheet conveyed into a said nip, wherein an edge of said heater element being located adjacent to the surface of one of said rolls;

wherein said heater element elevates the temperatures of a sheet carrying a toner image so as to make said toner semimolten and said pair of rolls elevates said sheet temperature further to fix said toner image and the surface temperature of said heated roll along its axial length is less at its ends than at its central portion and said surface temperature of said heater element is greater at end portions thereof, adjacent ends of said rolls, than at a central portion of said heater element, whereby the toner image will be melted uniformly.

2. The thermal fixing apparatus as claimed in claim 1, wherein a surface temperature of said heater element is less than 250° C.

3. The thermal fixing apparatus as claimed in claim 1, further comprising a temperature sensor means in thermal contact with the surface of said heater element and adapted to control the surface temperature of said heater element and said heated roll.

* * * * *